United States Patent [19]

Marshall

[11] Patent Number: 4,545,718

[45] Date of Patent: Oct. 8, 1985

[54] BIAS CUTTER FEEDER AND LETOFF TRUCK

[75] Inventor: Richard P. Marshall, Richfield, Ohio

[73] Assignee: The Goodyear Tire & Rubber Company, Akron, Ohio

[21] Appl. No.: 627,112

[22] Filed: Jul. 2, 1984

Related U.S. Application Data

[63] Continuation of Ser. No. 392,563, Jun. 28, 1982, abandoned.

[51] Int. Cl.[4] ..... B65H 25/26; B65G 65/00; B26D 5/20; B29H 17/02

[52] U.S. Cl. ..... 414/401; 83/36; 83/220; 83/581; 156/406.4; 198/631; 242/57.1

[58] Field of Search ..... 414/396, 398, 401, 584; 242/57.1, 58, 58.6; 156/406.4; 83/36, 219, 220, 581; 104/49; 198/631, 865, 509; 226/20

[56] References Cited

U.S. PATENT DOCUMENTS

| | | | |
|---|---|---|---|
| 1,507,301 | 9/1924 | Williams | 198/631 X |
| 3,069,027 | 12/1962 | Dischinger | 198/509 X |
| 3,098,555 | 7/1963 | Harriott | 198/865 |
| 3,325,072 | 6/1967 | Black et al. | 226/20 |
| 3,795,166 | 3/1974 | Brand | 83/220 |
| 4,010,664 | 3/1977 | Marshall | 83/277 |
| 4,119,193 | 10/1978 | Smith et al. | 198/631 X |

*Primary Examiner*—Joseph E. Valenza
*Assistant Examiner*—David A. Bucci
*Attorney, Agent, or Firm*—Frederick K. Lacher; T. P. Lewandowski

[57] ABSTRACT

A letoff truck having wheels for rolling the truck to and from a bias cutter feeder is releasably connected to the feeder for movement of the truck with the feeder during angular adjustment of the feeder for a desired bias angle setting. The truck is also mounted for transverse movement relative to the feeder to compensate for deviations in the position of the edge of the goods conveyed from the letoff truck to the feeder. Adjustment of the feeder angle about a pivot axis to provide the desired bias angle setting is provided by a powered sprocket mounted on the feeder and positioned between idler sprockets. The sprockets are engageable with a chain member extending between the ends of a transverse track on which one end of the feeder is supported by rollers. When the desired feeder position is obtained the feeder may be positively locked in that position.

9 Claims, 4 Drawing Figures

BIAS CUTTER FEEDER AND LETOFF TRUCK

This is a continuation, of application Ser. No. 392,563 filed June 28, 1982 now abandoned.

This invention relates to apparatus for transporting sheet material and especially, as indicated, to a feeder and letoff truck for transporting sheet goods to a bias cutter for cutting reinforcing cord breakers used in the manufacture of tires. Problems have been experienced in releasably connecting a letoff truck to a feeder so that the truck is movable with the feeder during the setting of the bias angle and the truck is also movable in a transverse direction relative to the feeder to compensate for deviations in the position of the edge of the goods transported from the truck to the feeder. There have also been problems providing angular adjustment of the feeder quickly and accurately and then locking the feeder in position during operation at a specified bias angle setting. These problems have been aggravated by the need for greater precision and efficiency in the handling and transporting of breaker material for making tires.

In accordance with an aspect of this invention there is provided an apparatus for transporting sheet goods comprising a feeder conveyor having an entry end and a discharge end, said conveyor having a supporting frame mounted for movement about a pivot at said discharge end and for arcuate transverse movement about said pivot at said entry end to adjust the feeder position, a truck member for transporting and storing said sheet goods, said truck member being supported on wheels and movable into position adjacent said frame at said entry end of said feeder conveyor, connecting means for releasably connecting said truck and said frame after said truck is moved into said operating position.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

Referring to the drawings.

Figure 1:
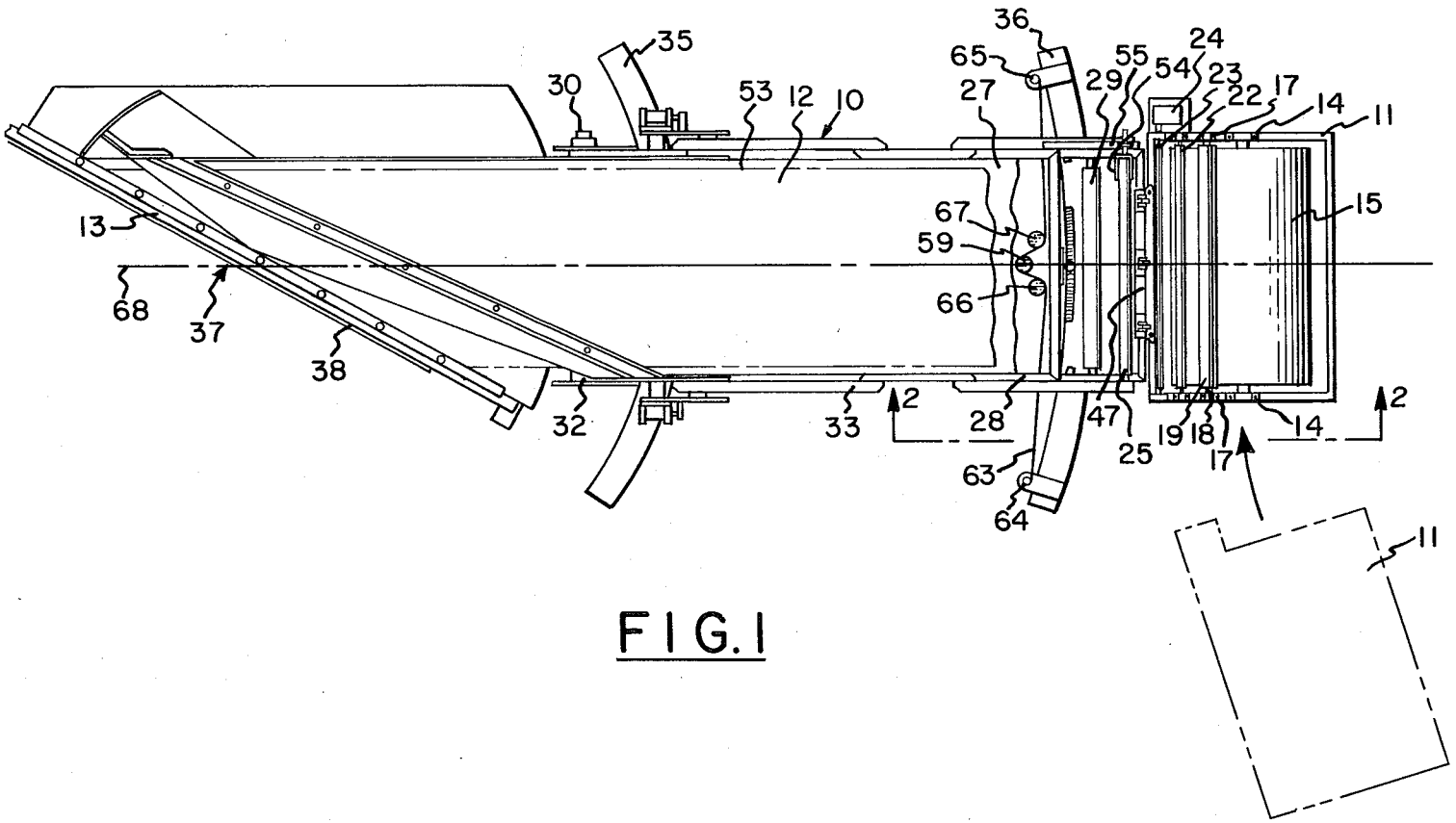
FIG. 1 is a schematic plan view of a bias cutter feeder and letoff truck embodying the invention.
Figure 2:
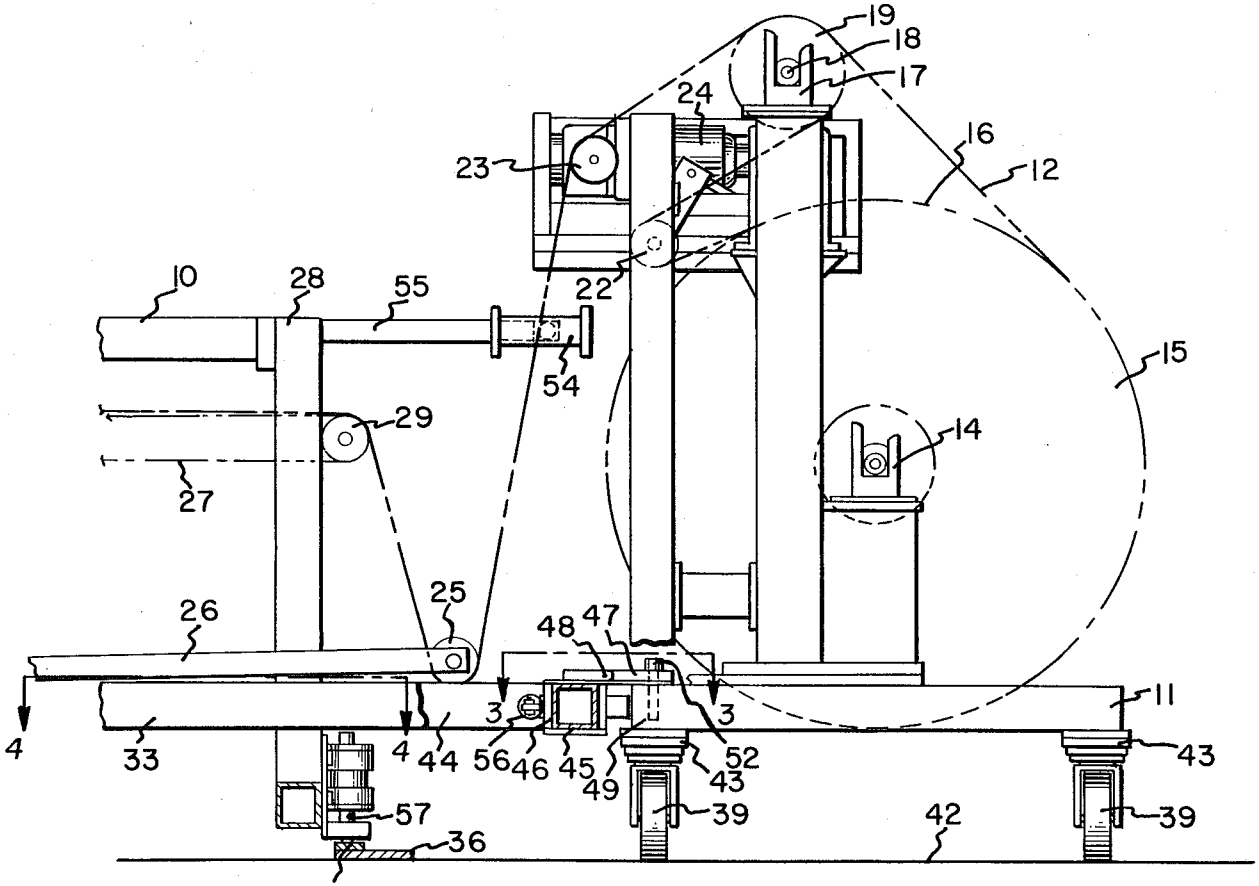
FIG. 2 is an enlarged fragmentary side elevation taken along the plane of line 2—2 of FIG. 1 with parts being broken away to show the slide and hinged connection between the truck and feeder frame.

Referring to FIG. 1, a feeder conveyor 10 and a letoff truck 11 are shown in position for transporting sheet goods such as reinforced elastomeric tire fabric 12, shown in chain-dotted lines, to a bias cutter 13. As shown in FIG. 2, the letoff truck 11 has a pair of lower forks 14 for supporting the ends of the shaft of a supply roll 15 on which the tire fabric 12 and a liner 16, shown in chain-dotted lines, are wound. An upper pair of forks 17 on the letoff truck 11 support a shaft 18 of a liner roll 19 on which the liner 16 is wound after being pulled off the supply roll 15 containing the liner and tire fabric 12.

An idler roller 22 is mounted on the truck 11 in a position for separating the liner 16 from the tire fabric 12 as it is pulled off the supply roll 15. A second idler roller 23 for guiding the fabric 12 off the liner roll 19 is also mounted on the truck 11. The shaft 18 of the liner roll 19 is driven by a motor 24 on the truck 11 connected to suitable source of power.

From the second idler roller 23, the tire fabric 12 passes around a dancer roller 25 supported on arms 26 hinged to the feeder conveyor 10 for substantially vertical movement of the dancer roller. This vertical movement is measured and a clutch connecting the shaft 18 to the motor 24 is controlled in response to the position of the dancer roller 25. The tire fabric 12 may then be carried by a conveyor belt 27, shown in dot-dash lines, between a belt roller 29 at an entry end 28 of the feeder conveyor 10 to a seond belt roller 30 at a discharge end 32 of the feeder conveyor. The second belt roller 30 is adjacent the rearward edge of a feed pan which has a smooth continuous surface supporting the full width of the tire fabric 12 and may be of the design desribed in U.S. Pat. No. 4,010,664 dated Mar. 8, 1977. In some applications the feeder conveyor may not have the belt 27 and the movement of the fabric 12 to the bias cutter 13 is provided by a reciprocating feed clamp apparatus.

Figure 4:
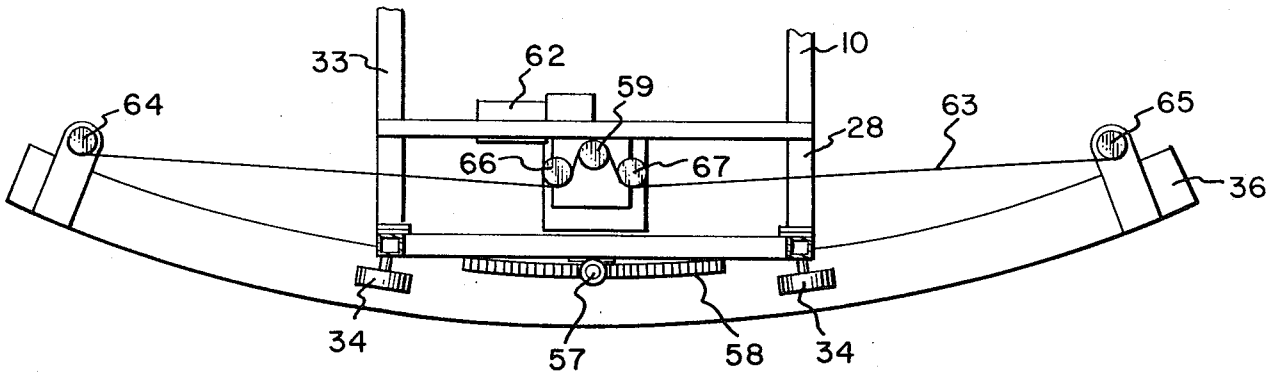
FIG. 4 is an enlarged fragmentary plan view of the feeder frame angle adjustment apparatus.

The feeder conveyor 10, illustrated in FIGS. 1, 2 and 4, includes a supporting frame 33 having wheels 34 positioned for rolling engagement with arcuate tracks 35 and 36, the arcs of which have a common center in a pivot axis 37 which extends perpendicular to the shear line 38 along which the tire fabric 12 is severed. The bias cutter 13 for severing the tire fabric 12 is entirely conventional and therefore is not shown in detail or further described. A particularly satisfactory apparatus with which the feeder conveyor 10 is associated is furnished by Spadone Machine Company of Norwalk, Conn.

Figure 3:
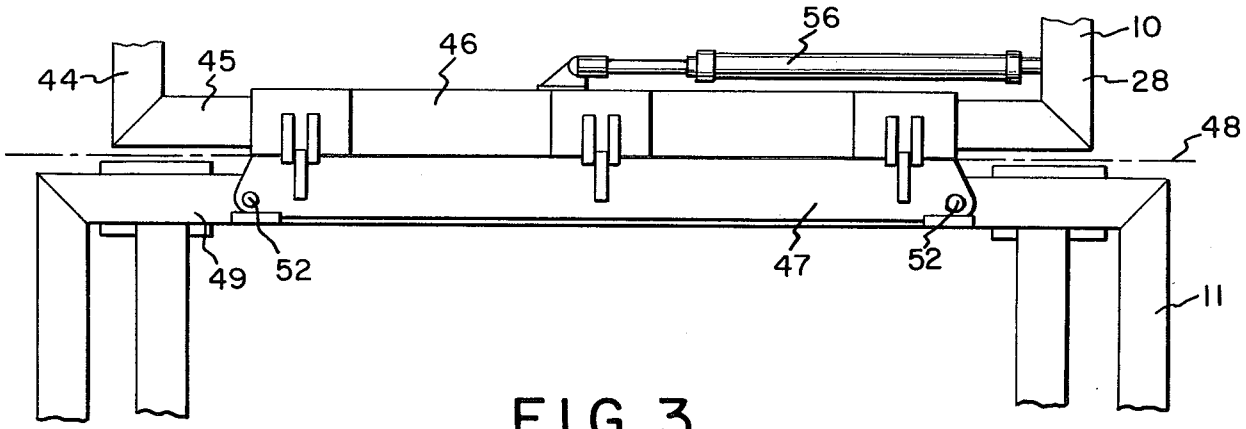
FIG. 3 is an enlarged fragmentary plan view taken along the plane of line 3—3 in FIG. 2 showing the connection between the feeder and letoff truck.

As shown in FIG. 2, the letoff truck 11 is supported on wheels 39 so that the truck may be transported along a flat surface such as floor 42 from a location where the supply roll 15 of tire fabric 12 is placed in the truck to a position adjacent the supporting frame 33. Of the four wheels 39 on the truck 11, preferably two are mounted on fixed axes and two are mounted on swivel axes 43 as shown in FIG. 2. This facilitates rolling the truck 11 from a position such as that shown in chain-dotted lines in FIG. 1 in the direction of the arrow into the position shown in full lines. The supporting frame 33 may be made of square tube members 44 of which a transverse member 45 located at the entry end 28 has connecting means for releasably connecting the truck 11 to the supporting frame while both the truck and the frame are stationary. The connecting means may include alignment means such as a square tubular slide 46 slidably mounted on the transverse member 45 and carrying a hinged plate 47 movable about a transverse axis 48 from a raised position providing clearance for movement of the truck 11 alongside the transverse member 45 to a lowered position over a transverse member 49 of the truck as shown in FIGS. 2 and 3. Fastening means such as pins 52 may be inserted through holes in the plate 47 aligned with holes in the transverse member 49.

It is important that the tire fabric 12 be conveyed to the bias cutter 13 with an edge 53 at a predetermined position so that the fabric will be cut precisely at a specified angle by the bias cutter. Accordingly the edge 53 of the fabric 12 passes through a sensing means which may be a photoelectric cell unit 54 adjustably mounted on a rod 55 fastened to the entry end 28 of the frame 33 of the feeder conveyor 10. A power means such as hydraulic piston and cylinder assembly 56 is interposed between and connected to the frame 33 and slide 46 for moving the slide along the transverse member 45 in response to signals from the photoelectric cell unit 54 indicating deviations in the position of the edge 53 of the fabric 12 as it is conveyed from the truck 11 to the feeder conveyor 10.

The supporting frame 33 of the feeder conveyor 10 is held in stationary position by suitable means while the truck 11 is moved on the wheels 39 relative to the feeder conveyor by the piston and cylinder assembly 56. In the embodiment, as shown in FIGS. 2 and 4, the entry end 28 of the supporting frame 33 is held in position by a positive locking means such as a pneumatically actuated slide bolt 57 mounted on the entry end 28 of the frame 33 and engageable with a fixed member such as a notched bar 58 mounted on the arcuate track 36 which is fastened to the floor 42. The slide bolt 57 is extended downwardly to engage a notch of the notched bar 58 during operation to maintain the feeder conveyor 10 in a feeder conveyor position with a predetermined feeder angle relative to the bias cutter 13. This also prevents movement of the supporting frame 33 while the truck 11 is being moved by the piston and cylinder assembly 56 to compensate for deviations in the position of the edge 53 of the fabric 12.

When it is desired to operate the feeder conveyor 10 with the letoff truck 11 attached thereto at a different feeder angle, the slide bolt 57 may be retracted from the notch in the notched bar 58 by actuating the pneumatic mechanism. The supporting frame 33 may then be moved about the pivot axis 37 by the following adjusting means shown more clearly in FIG. 4. A powered sprocket 59, driven by a gearmotor 62, is mounted on the supporting frame 33 and a chain 63 engageable with the sprocket 59 extends transversely from a position at one side of said frame to a position at the other side of the frame where the chain is secured by side sprockets 64 and 65 which may be mounted on the arcuate track 36 fastened to the floor 42.

Idler sprockets 66 and 67 are also mounted on the supporting frame 33 of the feeder conveyor 10 for guiding the chain 63 around the powered sprocket 59. Preferably the chain 63 is a double chain and the sprockets 59, 64, 65, 66 and 67 are double sprockets in engagement with the double chain so that upon rotation of the powered sprocket 59 by the motor 62, the truck 11 and the supporting frame 33 may both be moved to the new feeder conveyor position at the desired feeder angle. With this arrangement, the adjustment to a new feeder angle may be accomplished with precision and in a short period of time so that the delay in production is kept to a minimum. After the feeder conveyor position is adjusted, the slide bolt 57 may be lowered into position in a notch of the notched bar 58 for maintaining the feeder conveyor position with a desired feeder angle.

When all of the tire fabric 12 has been conveyed from the supply roll 15 on the truck 11 and the liner 16 wrapped around the liner roll 19, the pins 52 are removed and the hinged plate 47 lifted so that the truck 11 may be wheeled away from the feeder conveyor 10 to another location where a new supply roll of fabric and liner can be placed in the truck after removing the liner roll. In the meantime another truck 11 with a new supply roll 15 of tire fabric 12 may be wheeled into position at the entry end 28 from a location such as that indicated by chain-dotted lines in FIG. 1.

The positioning of the truck 11 is facilitated by the raising of the hinged plate 47 providing ample clearance for movement of the truck into position. Then after movement of the hinged plate 47 down into position over the transverse member 49 of the truck 11, the pins 52 may be inserted and the truck and feeder conveyor 10 are again in position for operation. The liner 16 may then be fed around the idler roller 22 and wrapped around the liner roll 19.

The tire fabric 12 is led over the liner roll 19 and over the second idler roller 23 under the dancer roller 25 and onto the conveyor belt 27. The feeder conveyor 10 and truck 11 are then in condition for conveying the tire fabric 12 to the bias cutter 13 with the edge 53 at a predetermined position.

The position of the edge 53 is maintained by the transverse movement of the truck 11 caused by movement of the piston and cylinder assembly 56 in response to signals from the photoelectric cell unit 54. Depending upon the position of the edge 53, signals are conveyed to a control unit (not shown) for actuating the piston and cylinder assembly 56. For example, if the edge 53 as shown in FIG. 1 is displaced toward the centerline 68 of the feeder conveyor 10, the photoelectric cell unit 54 will sense this and the piston and cylinder assembly 56 will be actuated so that the truck 11 will be moved upward as shown in FIG. 1 or to the right as shown in FIG. 3. Similarly if the edge 53 is displaced away from the centerline 68, the piston and cylinder assembly 56 will be actuated to move the truck 11 downward as shown in FIG. 1 or to the left as shown in FIG. 3. In this manner, the truck 11 is moved so that the edge 53 of the fabric 12 is moved a corresponding amount to compensate for deviations from the predetermined position on the feeder conveyor 10.

The belt 27 is driven to supply the needed quantity of tire fabric 12 as called for by the bias cutter through the means of sensing apparatus and conveyor drive and motor controls well known to those skilled in the art. The position of the dancer roller 25 indicates the need for more or less tire fabric 12 from the letoff truck 11 and this need is conveyed to the clutch of the motor 24 for regulating the amount of fabric 12 supplied by the rotation of the liner roll 19.

While a certain representative embodiment and details have been shown for the purpose of illustrating this invention, it will be apparent to those skilled in the art that various changes and modifications may be made therein without departing from the spirit or scope of the invention.

What is claimed is:

1. Apparatus for transporting sheet goods comprising a feeder conveyor having an entry end and a discharge end, said conveyor having a supporting frame mounted for movement about a pivot axis at said discharge end and for arcuate transverse movement about said pivot axis at said entry end to adjust the feeder conveyor position, a truck member for transporting and storing said sheet goods, said truck member being supported on wheels and movable into an operating position adjacent said frame at said entry end of said feeder conveyor, said frame having a transverse member, a single connecting means for releasably connecting said truck member and said frame after said truck member is moved into said operating position, said connecting means including an elongated outer slide member slidably mounted around said transverse member of said frame for maintaining said truck member in said operating position, a hinged plate on said slide member having a length substantially the same as the length of said slide member and movable about a transverse axis into a raised position to provide clearance between said frame and said truck member during movement of said truck member relative to said feeder conveyor and to a lowered position over said truck member after movement of said truck member into said operating position and fastening means positioned along the length of said hinged plate for connecting said plate and said truck member in said lowered position, power means interposed between said slide member and said frame for moving said slide member and said truck member transversely of said frame, sensing means for determining the position of at least one edge of said sheet goods as it is conveyed from said truck member to said feeder conveyor, and said slide member being movable by said power means along said transverse member in response to said sensing means to move said truck member and said sheet goods relative to said supporting frame to compensate for deviations in the position of said edge of said sheet goods from a predetermined position as it is conveyed from said truck member to said feeder conveyor.

2. Apparatus for transporting sheet goods comprising a feeder conveyor having an entry end and a discharge end, said conveyor having a supporting frame, a truck member for transporting and storing said sheet goods, said truck member being supported on wheels and movable into an operating position adjacent said frame at said entry end of said feeder conveyor, said frame having a transverse inner member, a single connecting means for releasably connecting said truck member and said frame after said truck member is moved into said operating position, said connecting means including an elongated outer slide member slidably mounted around said transverse inner member of said frame for maintaining said truck member in said operating position, a hinged plate on said slide member having a length substantially the same as the length of said slide member and movable about a transverse axis into a raised position to provide clearance between said frame and said truck member during movement of said truck member relative to said feeder conveyor and to a lowered position over said truck member after movement of said truck member into said operating position and fastening means positioned along the length of said hinged plate for connecting said plate and said truck member in said lowered position, power means interposed between said slide member and said frame for moving said slide member transversely of said frame, sensing means for determining the position of at least one edge of said sheet goods as it is conveyed from said truck member to said feeder conveyor, and said slide member being movable by said power means along said transverse inner member in response to said sensing means to move said truck member and compensate for deviations in the position of said edge of said sheet goods from a predetermined position as it is conveyed from said truck member to said feeder conveyor.

3. Apparatus according to claims 1 or 2 wherein said fastening means includes at least two pins and said hinged plate and said truck having holes along the length of said hinged plate for receiving said pins when in the aligned condition.

4. Apparatus according to claim 1 including adjusting means for moving said frame about said pivot axis to provide a feeder conveyor position with a predetermined feeder angle at which said sheet goods are transported on said feeder conveyor, said adjusting means comprising a sprocket mounted for rotation on said frame, a chain engageable with said sprocket and extending transversely from a stationary position at one side of said frame to a stationary position at the other side of said frame for arcuate transverse movement of said frame in response to rotation of said sprocket, and said sprocket being interposed between two idler sprockets mounted on said frame for guiding said chain over said sprocket.

5. Apparatus according to claim 4 wherein said sprocket is driven by a motor.

6. Apparatus according to claim 1 including positive locking means mounted on said frame as a position adjacent said entry end and said locking means being engageable with a fixed member for maintaining said feeder conveyor position with a feeder angle at which said sheet goods are transported.

7. Apparatus according to claim 6 wherein said positive locking means comprises a slide bolt and said fixed member comprises a notched bar having notches for receiving said bolt.

8. Apparatus according to claim 4 including positive locking means mounted on said frame at a position adjacent said entry end and said locking means being engageable with a fixed member for maintaining said feeder conveyor position within a feeder angle at which said sheet goods are transported.

9. Apparatus according to claim 3 wherein said sprocket is driven by a gearmotor, said positive locking means comprises a slide bolt and said fixed member comprises a notched bar having notches for receiving said bolt.

* * * * *

UNITED STATES PATENT OFFICE
CERTIFICATE OF CORRECTION

Patent No. 4,545,718 Dated October 8, 1985

Inventor(s) Richard P. Marshall

It is certified that error appears in the above-identified patent and that said Letters Patent are hereby corrected as shown below:

Column 6, line 48 "Apparatus according to claim 3 wherein said" should aread --Apparatus according to claim 8 wherein said--.

This certificate supersedes Certificate of Correction issued May 6, 1986.

Signed and Sealed this

Twentieth Day of January, 1987

*Attest:*

DONALD J. QUIGG

*Attesting Officer* *Commissioner of Patents and Trademarks*